US005836588A

United States Patent [19]

Gerson

[11] Patent Number: 5,836,588

[45] Date of Patent: Nov. 17, 1998

[54] INTERACTIVE WALL ART

[76] Inventor: Joanne Gerson, 7714 Stonehenge Dr., Cincinnati, Ohio 45242

[21] Appl. No.: 630,269

[22] Filed: Apr. 10, 1996

[51] Int. Cl.[6] ..... A63B 67/00

[52] U.S. Cl. ..... 273/348.4; 473/573; 273/DIG. 30

[58] Field of Search ..... 273/346, DIG. 5, 273/DIG. 30, 344, 345, 347, 348.4; 40/594; 473/573

[56] References Cited

U.S. PATENT DOCUMENTS

| | | | |
|---|---|---|---|
| 2,755,555 | 7/1956 | Spaeder | 40/594 X |
| 3,941,383 | 3/1976 | Clarke | 273/346 |
| 3,997,162 | 12/1976 | Scullin | 273/346 |
| 4,113,251 | 9/1978 | Imes, Jr. | 273/346 |
| 4,452,362 | 6/1984 | Mancin | 211/75 |
| 4,543,278 | 9/1985 | Ackerman | 428/18 |
| 4,749,604 | 6/1988 | Foster | 428/100 |
| 4,863,176 | 9/1989 | Lapkewych | 273/346 |
| 4,900,604 | 2/1990 | Martinez et al. | 428/79 |
| 4,971,333 | 11/1990 | Buselli | 273/346 |
| 5,117,988 | 6/1992 | Daniels | 211/13 |
| 5,294,130 | 3/1994 | Woods et al. | 273/346 |
| 5,344,155 | 9/1994 | Huang | 273/346 |
| 5,344,356 | 9/1994 | Pizzelli et al. | 446/73 |
| 5,438,972 | 8/1995 | Harbin | 273/DIG. 5 X |

OTHER PUBLICATIONS

Super Stars Sports Games Advertisement Dec. 1977 273–DIG. 30.

*Primary Examiner*—William H. Grieb
*Attorney, Agent, or Firm*—Frost & Jacobs

[57] ABSTRACT

Interactive wall art is a game to be played indoors by one or more children. The game consists of a self-adhesive mural portraying characters playing an action sport, a loop-threaded stuffed ball corresponding to the sport portrayed in the mural, and a hook-threaded fabric target attached to the mural in an appropriate location to facilitate the fantasy of actually playing a game with the figures on the wall mural. The game encourages creative role play and physical exercise including pitching, throwing, kicking, running and jumping.

13 Claims, 2 Drawing Sheets

INTERACTIVE WALL ART

TECHNICAL FIELD

The present invention relates generally to a target game, and is particularly directed to a combination game and mural which simulates playing a sport and ornaments a child's room.

BACKGROUND OF THE INVENTION

Children tend to have vivid imaginations, be energetic, and enjoy sporting activities. Oftentimes, they engage in play that can be dangerous to themselves and harmful to their surroundings. Parents sometimes find themselves worrying about their children's safety in playing sports outdoors, fearing that they may be injured. On the other hand, parents typically do not appreciate when their children play excessively active games, such as ball, in the home, because such activities tend to result in broken household items. Consequently, parents find themselves conflicted between their desire to encourage their children's fun, exercise, and activity and their desire to keep their children and belongings safe. Furthermore, parents and children generally enjoy decorating children's rooms with agreeable art work. In many situations, it is desirable to both ornament a child's bedroom or playroom with a mural and to utilize that decoration to safely enhance the child's imagination and play with a wall toss game. Prior wall toss games typically describe target-type games which do not have the aesthetic features nor the imagination-stimulating features associated with the mural aspects of the present invention.

For example, U.S. Pat. No. 3,941,383 (Clarke), issued Mar. 2, 1976, discloses a sports-related target game with a printed baseball player on the target. Clarke shows a knit nylon and urethane foam wall-hanging target having loop-threaded material, and a ball partially covered by hook-threaded material. The loop-threaded and hook-threaded fastening materials are known as VELCRO™. The target must be attached to the wall with a nail, screw, hook or other similar object that will mar the wall.

U.S. Pat. No. 4,971,333 (Buselli), issued Nov. 20, 1990, describes a wall hanging, toss game in which the projectile is covered with or made of loop-threaded material and the target comprises areas of hook-threaded material. This game has no decorative aspect, as in a mural. It does not appear to stimulate imagination or creative thinking, as in the make-believe aspects associated with the interactive wall art of the present invention. It has a three-dimensional complicated structure and does not suggest or describe a self-adhesive sheet. The catch area needs to be folded back at the end of play so that the wall hanging is flat against the wall. Depending on the location of the wall hanging, the construction may be a problem, necessitating folding after each use to prevent personal injury by bumping into the game.

U.S. Pat. No. 5,344,155 (Huang), issued Sep. 6, 1994, discloses a spherical projectile coated with hook-threaded material and a target having loop-threaded fabric secured to a supporting screen for grasping the projectile upon contact. The Huang device does not appear to be a wall-hanging, rather, it is supported on a horizontal surface, such as a table or shelf. Furthermore, it has many of the disadvantages as the Buselli device, including lack of aesthetic utility, lack of an illustration to encourage imaginative play, a three-dimensional structure, and no self-adhesive material.

None of the patents discussed discloses or suggests the precise combination of features of this invention. While all of these patents describe target games with VELCRO™ elements, none of them discloses a wall toss game which doubles as a mural. Nor do they teach or suggest the flexible mural material, such as a vinyl or polyester sheet, the self-adhesive feature, or the wall-sparing repositioning feature of the present invention.

The interactive wall art of the present invention overcomes many of the shortcomings of the prior art. Because of its self-adhesive backing, screws, nails, or other fasteners are not required for mounting. Consequently, there is no need to drill holes or mar any walls, and after removal, the wall is left undamaged. On a related note, the mural's lightweight and flexible construction is easy to manipulate and reduces the risk of injury. In the unlikely event that the mural would come off unexpectedly, there is no danger of a heavy material falling off the wall onto a child. Further, it can be easily rolled up for storage.

Another advantage of repositionable mural material is that, moving the mural of the player(s) on the wall to various positions can add variety to the game or make the skill level more challenging. As the child grows, the height of the image can be raised to simulate accurately the appropriate height of the target. The mural can be moved to another room or removed and easily stored by reapplying the backing and rolling up the mural.

Yet another advantage of an aspect of the present invention is that the space surrounding the VELCRO™ target area is the mural material, preferably a vinyl or polyester sheet, which protects the wall from fingerprints when the balls are pulled off the hook VELCRO™ attached to the mural. The material is easy to clean; finger prints simply wipe off with a damp cloth.

Although the related art shows target games, the interactive wall art of the present invention encourages creative role play as well as exercise including but not limited to throwing, pitching, kicking, running, and jumping. It is like playing the actual sport indoors with one or more make-believe depicted players. The projectile may be made for simulating a baseball, football, basketball, soccer ball, hockey puck, or projectiles of other games. The simulated ball and target mural creates a decorative, safe, and imaginative playing environment for children.

The mural is pleasing to look at and considerably less expensive than having an artist paint the mural on the wall. A clear or transparent background is preferable because it creates the appearance that the mural is painted on the wall. The wall color showing through the spaces around the figures on the mural fabric enhance the coordinating effect so that it will look good in any color scheme.

Because the ball is soft, it will not hurt anyone hit by it nor is it likely to damage anything it hits. If the loop component of the fastener is used on the exterior of the ball it will not collect lint and debris, nor will it get caught in clothing or other fabrics in the room. The ball is unlikely to leave dark smudges on the wall where it hit the wall or mural fabric.

There is a need in the art for a wall target type game that simulates an actual sport and creates a decorative, safe, and imaginative playing environment for children, which can be mounted on a wall without causing the wall damage.

SUMMARY OF THE INVENTION

It is a primary object of the present invention to provide a wall target game which simulates a sport and which also serves as a mural to decorate a child's room.

It is another object of the present invention to provide a game that will stimulate a child's imagination.

It is yet another object of the present invention to provide a game that is safe for children.

It is still another object of the present invention to provide a game that has a soft ball covered with loop-threaded material.

It is a further object of the present invention to provide a game that includes a mural portraying figures playing a sport, where the mural is printed on a flexible transparent vinyl or polyester sheet.

It is still a further object of the present invention that the mural include a self-adhesive paper-covered backing, such that the sheet may be removably adhered and reapplied to a wall without additional fasteners.

It is yet a further object of the present invention that the sheet include a target having a portion of hook-threaded material that matingly corresponds to the loop-threaded material covering the ball, such that when the ball hits the target, it becomes removably attached.

To achieve the foregoing and other objects, and in accordance with the purposes of the present invention as described herein, a game is provided. In one aspect of the invention, the game includes a projectile, such as a ball. In another aspect of the invention, the projectile simulates a ball from a real sport such as a baseball, football, basketball, soccer ball, tennis ball, table tennis ball, or hockey puck. In another aspect of the invention, the outside surface of the projectile is covered with a first attachment means. Preferably, that first attachment means is loop-threaded material. The game also includes a flexible mural material or sheet. Preferably, the flexible sheet is made of transparent vinyl or polyester and has an area greater than four square feet. The sheet has a front surface and a back surface. The front surface illustrates a scene, and in one aspect of the invention, at least a portion of the front surface is covered with a second attachment means that matingly corresponds to the first attachment means. Preferably, the second attachment means is hook-threaded material which matingly corresponds to the loop-threaded material on the projectile. Preferably, the scene shows at least one character, such as a human character, playing a sport. The back surface has adhesive material on it, such that the sheet may be removably adhered to a wall without additional fasteners. The adhesive material should allow for reapplication of the sheet after removal. In yet another aspect of the invention, the game includes an accessory having attachment means for attaching the device to the flexible sheet. Preferably, the accessory relates to a sport, and most preferably relates to baseball, football, basketball, soccer, tennis, table tennis, or hockey. The attachment means is preferably made of VELCRO™.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

BRIEF DESCRIPTION OF THE DRAWINGS

The accompanying drawings incorporated in and forming a part of the specification illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
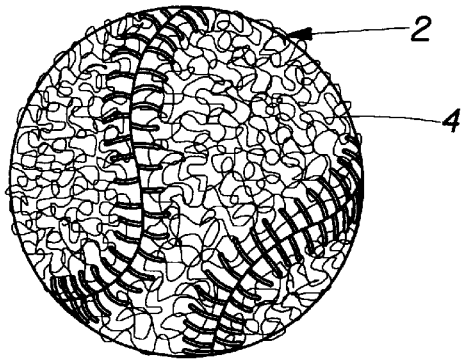
FIG. 1 shows an embodiment of the present invention wherein the projectile is a ball with a loop-threaded fastener on its surface.
Figure 4:
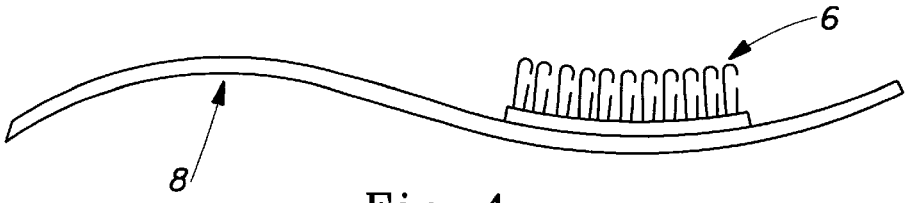
FIG. 4 is an enlarged view of a hook-threaded fastener of an embodiment of the present invention.

Referring now to the drawings in detail, wherein like numerals indicate the same elements throughout the views, FIG. 1 shows an embodiment of the projectile 2 having a loop-threaded fastening surface 4. The projectile 2 can be any shape, size or color. Preferably, a familiar shape, size, and color variant is used for the projectile, for example: football, basketball, soccer ball, tennis ball, or hockey puck. The projectile 2 in this embodiment imitates a baseball. Preferably, the ball 2 looks like its real counterpart in terms of color, size, shape, and stitching. The ball 2 is preferably soft and pliable enough to promote safety, but rigid enough to bounce a distance from the wall, when it does not hit the hook-threaded target 6. The ball 2 can be made of any material that would be removably attachable to at least a portion of the mural 8. Examples of materials from which the projectile can be made are: a sponge material which would, by its own porous physical configuration, adhere to the attachment means on the mural material; a sponge such as that known as NERF™ material covered with the loop-threaded material 4 which would matingly correspond to hook-threaded material 6 on the mural 8; and appropriate toy stuffing 10 with the surface covered by loop-threaded material 4, as shown in FIG. 4.

Figure 3:
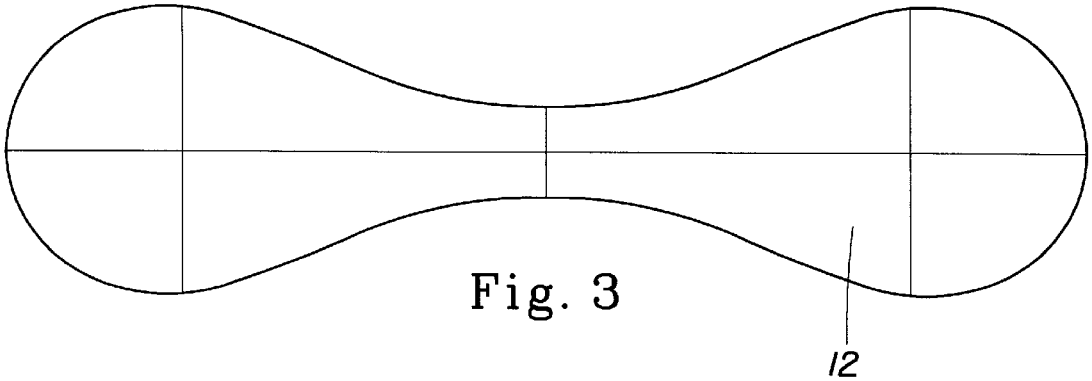
FIG. 3 shows the shape of the pieces of fabric of the ball in FIG. 2.
Figure 2:
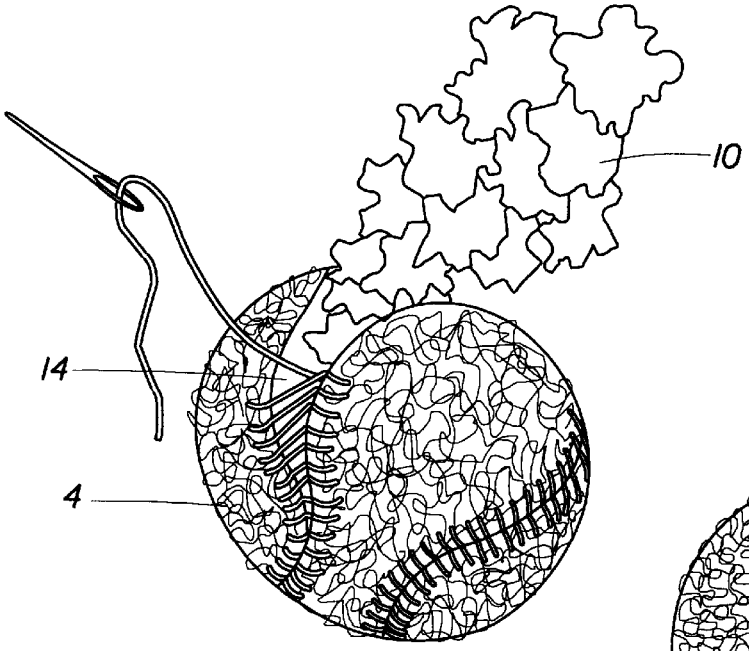
FIG. 2 illustrates that the surface of the ball of FIG. 1 is sewn from separate pieces of fabric.

As shown in FIGS. 1, 2, and 3, the projectile 2 can be sewn from appropriately cut material 12 and then stitched 14 to imitate its real counterpart, such as a baseball, though it does not have to be sewn. The ball can be assembled in any way that will further the objects of the invention. For example, the outer material can be adhered on to the inner ball material by gluing or by using sticky-back loop-threaded material.

Figure 6A:
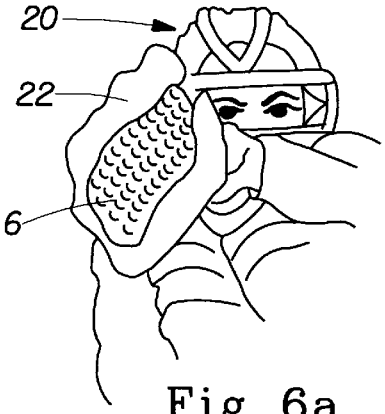
FIG. 6*a* is an enlarged view of a portion of the illustration of FIG. 6, showing the hook-threaded fastener attached to a portion of the mural material.
Figure 6B:
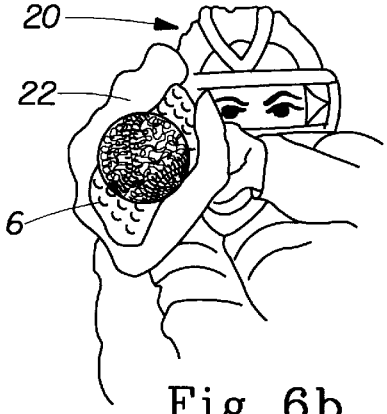
FIG. 6*b* shows the hook-threaded fastener of FIG. 6*a* with a loop-threaded ball positioned thereon.
Figure 5:
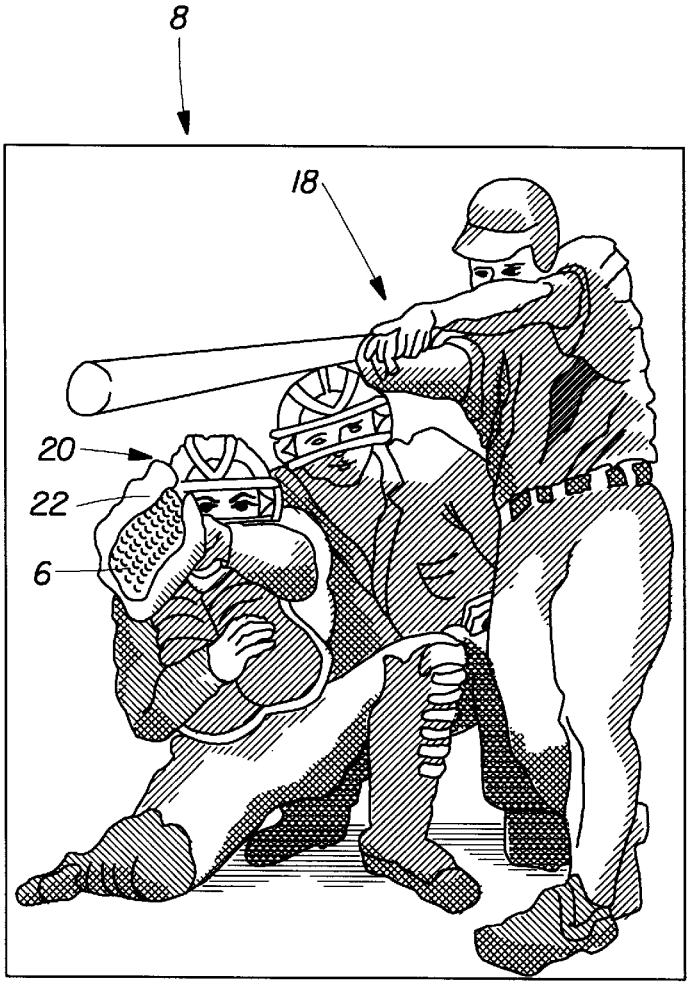
FIG. 5 shows an embodiment of the mural of the present invention, particularly, a clear adhesive vinyl sheet as the mural material of the present invention, including an embodiment of the mural illustration, namely, human characters in baseball uniforms.

FIG. 6 illustrates an embodiment of the mural 8. The mural material 16 can be any flexible material that could accept an adhesive back surface for adhering to a vertical surface, such as a wall. Preferably, the mural material 16 is a clear vinyl sheet. The sheet 16 may be made of materials other than clear vinyl, though a flexible plasticized material is preferable. Some examples of materials that could be used are paper, cloth fabric, polyester, plastic, rubber, and vinyl. The flexibility of the sheet 16 allows for easy roll-up storage. On the back side, the sheet 16 has low-pressure adhesive (not shown) to allow for mounting onto a wall without the need for additional fasteners. Once removed, the sheet 16 can reapplied or repositioned on the same or a different wall. Preferably, there is attached to the sheet 16 a backing (not shown), such as paper, for covering the adhesive to reduce the amount of dust and debris that could collect on the adhesive material while the interactive wall art is not in use. On the front of the sheet 16 is an illustration 18 which forms the mural 8. In the embodiment shown in FIG. 6, the illustration 18 depicts human uniformed characters playing baseball. Generally, it is preferable that the illustration 18 depict figures playing some sport, to enhance the fanciful aspect of the invention. One character 20 behind home plate (not shown) is the catcher wearing a baseball mitt 22. Attached to the baseball mitt 22 is hook-threaded material 6, preferably matching the brown color of the mitt 22. FIGS. 7*a* and 7*b* show the catcher 20 with his hook-threaded 6 fabric-covered mitt 22. The hook-threaded material 6, enlarged in FIG. 5, mates with the loop-threaded material 4 covering the ball 2.

The mural 8 can be any size, but is preferably large to heighten the imaginative aspects of the game. For example, the mural 8 can be approximately four feet from top to bottom, estimating life-sized children. Alternatively, the mural 8 can be as large or as small as the wall upon which it is placed. For a child's room, that size might be smaller than, for example, a nursery school wall or a playyard wall. For the sake of enhancing the make-believe aspects, it is preferable that the mural have an area of at least four square feet.

The invention plays to both the imaginative and physical nature of children. Imagine a child in his bedroom or in his playroom. On the walls are the murals of near life-size figures. These figures appear to be playing a sport, such as baseball, basketball, or soccer. The figures are printed on a low-pressure adhesive clear vinyl that can be attached or removed from the wall without harming the surface of the wall. The child is a participant in an imaginary game that he is playing with these figures. The child is using a ball 2, similar in color, size and shape to the ball representing a sport. This ball 2 is preferably soft so that it can be thrown indoors with little risk of breaking household items. More importantly, the ball is preferably made of a loop-threaded fabric 4 like VELCRO™ and the hook-threaded mate 6 to the VELCRO™ system is on the wall mural 8 in the mitt 22.

It may be any sport, but for this description, these figures will be playing baseball. In this game, the child is the pitcher. He pitches the baseball made of loop fabric 4 to at figure or group of three figures found at home plate: the batter, the catcher and the umpire. The batter is in mid-swing, the catcher 20 is holding his glove 22 ready to catch an incoming pitch and the umpire is in position to observe the pitch. The catcher's glove 22 has a piece of hook-threaded fabric 6 attached to its catching area. In this imaginary baseball game, the pitcher (child) will attempt to strike out the batter by throwing the ball 2 into the glove 22 so that the loop ball 2 sticks to the hook glove 22.

Now let your imagination run. To the pitcher's (child) left is first base. A mural with the first baseman is on the appropriate wall, a runner can be seen approaching first base. A picture of the first baseman with his foot on the bag and his glove, with hook fabric in place, is ready to catch the throw. The picture of the center fielder has his glove, with hook fabric, ready to catch the fly ball. The child throws the ball. If it hits the wall, missing the center fielders glove, then the child can pretend to transform into the right fielder who swiftly throws the ball to the first baseman's glove, with hook fabric in place, to tag the runner out.

The entire outfield team can be illustrated on the sheet murals on the walls of this room in their appropriate positions. Each glove contains the hook fabric to catch balls. Also on the walls are the opposite team's base runners. For example, one player can be shown sliding into second base and another runner can be heading to third base.

The invention can be expanded to include other sports. Further, the invention can include a three-dimensional accessory attached or attachable to the wall or the mural material. The ideas are not limited to the following examples which are provided to demonstrate versatility. To simulate a game of basketball, the basket can be created by either a three-dimensional basket that is attached to the mural with or without the hook and loop lock system or a two-dimensional illustration of the basket with the hook fabric covering the opening. The opening can be almost round in shape creating the illusion that the child is either looking up into it from the bottom or looking down into it from the top. Players wearing two opposing team uniforms, can be placed about the room walls. Some of the players can have hook fabric on their hands in order to catch the ball. The ball made of loop fabric will be larger than the baseball and look like a basketball.

In sports that use a net, such as soccer or hockey, the lines that form the netting could be covered with the hook fabric. The posts that support the netting preferably would not have hook fabric on them because the ball would bounce off the metal frame. The, perspective used to create the illusion of a three-dimensional goal would produce a trapezoid space representing the ground inside the goal area. This trapezoid space could also be covered with portions of hook fabric. The goalie standing in front of the goal could have hook fabric on his gloves to catch the ball. The soccer ball would preferably be made of the loop fabric and look like a real soccer ball, but soft for indoor play. The hockey idea would be ideal in a large playroom or indoor yard where the child could roller blade and play with a plastic stick and soft puck made of loop fabric. Football does not use a net but does have field goals kicked between the goal uprights. So, the space between the uprights could be covered with the hook fabric. In the end zone area, an illustration of a member of the child's team could be ready to catch the ball. The child could be the quarterback or the kicker, depending on the play.

These are examples of some applications of the present invention, but in no way is the invention intended to be limited to the described illustrations.

The projectile or ball 2 can be made from a variety of materials, and in a variety of ways. Preferably, the ball could be sewn from fabric made of the loop component 4 of the hook and loop locking system. It is also preferable to have the loop-threaded fabric 4 for the ball and mating hook-threaded fabric 6 on the mural sheets against the wall, because the ball 2, being mobile, is more likely to collect lint if it is covered by hook fabric 6. However, having hook fabric 6 on the ball and loop fabric 4 on the wall is within the scope of this invention, as well. The ball 2 can be stuffed with shredded filling material 10 similar to that used in stuffed toys or stuffed with a solid filling material, such as a sponge or rubber form. Alternatively, the ball 2 can be made from a single material with an appropriate outer surface, such as a sponge. The hook component 6 of the locking system preferably has pressure sensitive backing that can stick to the material that the mural is made from, such as vinyl, particularly, plasticized vinyl. The color of the hook fabric 6 preferably matches the color of the object that serves as a goal or catching part in the illustration on the vinyl mural 8. The ball 2 is preferably soft enough that it is unlikely to break household objects when thrown indoors and firm enough to bounce a short distance off a hard surface.

The mural 8 is preferably printed from original art work illustrating action players 18 of a particular sport. The art work is transferred to the mural material 16, which is preferably a sheet of low pressure sensitive removable clear vinyl. This can be massed produced. The mural material 16 is capable of attaching to a wall without additional fasteners. The mural material 16 can be removed and if desired, put up on another wall. The murals should serve to enhance the appearance of the walls.

The hook fabric 6 is preferably attached to the mural material 16 before the product is sold, to facilitate ease of use and minimize children's safety hazards which could occur due to improper application of the hook fabric 6 onto the mural 8. The hook fabric 6 preferably has a pressure sensitive adhesive backing that will stick to the mural material 16. Such a backing is known in the art and is manufactured by the makers of VELCRO™.

Famous sports figures and actual team uniforms can be used in the illustrations. The art work can be realistic figures, cartoon figures or caricature figures. Additional art work could include, but is not limited to, the faces of the fans watching the game. This could become a border design for the room, for example.

Obvious applications for the present invention are in a child's bedroom or playroom. The game may also be used in locations such as nursery schools, recreation centers, camps, day care settings or other indoor environments for children. The game allows children to be physically active with less chance of getting hurt because the ball is soft and there are no objects to swing, such as baseball bats.

It also gives a child the opportunity to improve throwing or kicking skills used in play of the real sport illustrated. To practice throwing or kicking a ball that is the actual size of the ball used in the real play of that sport, at a near life size target, year round, day or night, may benefit the child in the play of the actual sport.

The mural 8 is beautiful and will enhance the appearance of the room. It can stand alone as a work of art. This is important to commercial establishments, as well as home-owners. Many target games are bulky, taking up valuable space and are not attractive art that enhance the room decor. This mural becomes part of the wall, taking up no floor space. The ball 2 can be stored attached to the mural or put away with the other toys.

If the ball is made of the loop fabric it will not stick to other regular toys. If the mural is to be removed, it will not damage the wall to remove it, no holes will be left, and the mural with the original protective paper backing attached can be rolled up for storage.

In summary, numerous benefits have been described which result form employing the concepts of the invention. The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A game, comprising:

a projectile having an outside surface, the outside surface being covered with first attachment means; and a repositionable, mural-like flexible sheet, wherein the sheet has a front surface and a back surface, the front surface illustrating a scene, at least a portion of the front surface being covered with a second attachment means that matingly corresponds to the first attachment means, and the back surface having adhesive material thereon, such that the sheet may be removably adhered to a wall without additional fasteners and without damaging the wall, and wherein the adhesive material allows for reapplication of the sheet after removal.

2. A game as defined in claim 1, wherein said projectile simulates a projectile chosen from the group consisting of a baseball, football, basketball, soccer ball, tennis ball, table tennis ball, and hockey puck, and wherein the outside surface is entirely covered with the first attachment means.

3. A game as defined in claim 1, wherein said first attachment means is loop-threaded material and said second attachment means is hook-threaded material.

4. A game as defined in claim 1, wherein the flexible sheet is made of vinyl.

5. A game as defined in claim 1, wherein the flexible sheet is made of transparent vinyl.

6. A game as defined in claim 1, wherein the flexible sheet has an area greater than five square feet.

7. A game as defined in claim 1, wherein the scene depicts at least one character.

8. A game as defined in claim 1, wherein the scene depicts at least one character playing a sport.

9. A game as defined in claim 1, wherein the first attachment means is loop-threaded material, the second attachment means is hook-threaded material that matingly corresponds to the loop-threaded material, the flexible sheet is made of vinyl, and the scene is a character playing a sport.

10. A game, comprising:

a stuffed projectile having an outside surface, the outside surface being covered with loop-threaded material; and a flexible transparent vinyl sheet, wherein the sheet has a front surface and a back surface, the front surface illustrating a human character playing a sport, at least a portion of the front surface being covered with hook-threaded material that matingly corresponds to the loop-threaded material, such that the projectile attaches to the hook-threaded material on the sheet, and the back surface having adhesive material thereon, such that the sheet may be removably adhered and reapplied to a wall without additional fasteners.

11. A game, comprising:

a flexible sheet, wherein the sheet has a front surface and a back surface, the front surface illustrating a scene, and the back surface having adhesive material thereon, such that the sheet may be removably adhered to a wall without additional fasteners; and a three-dimensional, removable non-projectile, fixed accessory having attachment means for attaching the accessory to the front surface of the flexible sheet, wherein said attachment means is made of VELCRO™ and wherein at least a portion of the front surface is covered with VELCRO™ that matingly corresponds to the VELCRO™ of the attachment means.

12. A game, comprising:

a flexible sheet, wherein the sheet has a front surface and a back surface, the front surface illustrating a scene, and the back surface having adhesive material thereon, such that the sheet may be removably adhered to a wall without additional fasteners;

a three-dimensional, removable, non-projectile, fixed accessory having attachment means for attaching the accessory to the flexible sheet; and a projectile, wherein said projectile simulates a projectile chosen from the group consisting of baseball, football, basketball, soccer ball, tennis ball, table tennis ball, and hockey puck, the accessory is related to a sport chosen from the group consisting of baseball, football, basketball, soccer, tennis, table tennis, and hockey, the attachment means is made of VELCRO™, the flexible sheet is made of transparent vinyl, at least a portion of the front surface is covered with VELCRO™ that matingly corresponds to the VELCRO™ of the attachment means, the scene depicts at least one character playing a sport, and the adhesive material allows for reapplication of the sheet after removal.

13. A game, comprising:

a flexible sheet, wherein the sheet has a front surface and a back surface, the front surface illustrating a scene, and the back surface having adhesive material thereon, such that the sheet may be removably adhered to a wall without additional fasteners;

a three-dimensional, removable, non-projectile, fixed accessory having attachment means for attaching the front surface of the accessory to the flexible sheet; and a projectile, wherein the attachment means of the accessory is loop-threaded material and the front surface of the sheet is partially covered with hook-threaded material which matingly corresponds, to said loop-threaded material, wherein the hook-threaded material is located in a fixed position on the sheet, such that the accessory is only repositionable with respect to the hook-threaded material, and wherein the projectile is covered with loop-threaded material and at least a portion of the front surface is a target area covered with hook-threaded material which matingly corresponds to the loop-threaded material of the projectile.

* * * * *